United States Patent [19]

Victor

[11] 3,963,216

[45] June 15, 1976

[54] CARPET STRETCHER

[76] Inventor: Harold Richard Victor, 1300 E. Elm, Olathe, Kans. 66061

[22] Filed: June 23, 1975

[21] Appl. No.: 589,434

[52] U.S. Cl. ..... 254/62

[51] Int. Cl.[2] ..... A47G 27/04

[58] Field of Search ..... 254/62, 63, 113, 116, 254/117

[56] References Cited

UNITED STATES PATENTS

| | | | |
|---|---|---|---|
| 549,044 | 10/1895 | Zander | 254/62 |
| 3,001,762 | 9/1961 | Skolnick | 254/62 |

*Primary Examiner*—Al Lawrence Smith
*Assistant Examiner*—Robert C. Watson
*Attorney, Agent, or Firm*—Schmidt, Johnson, Hovey & Williams

[57] ABSTRACT

A carpet stretcher of the type which normally uses a rear wall as a backstop when stretching carpet toward an opposite forward wall may be converted into a stretcher which pulls against a forwardly disposed tack strip during stretching if a rear wall is not available or is too remote to be of practical benefit. The converting attachment is secured to a stationary part of the basic tool behind its shiftable carpet-engaging head but extends forwardly beyond the head and terminates in a normally upright blade that catches behind the far side of the tack strip when in use to provide an anchor point for the stretcher. The head can thus be located in close proximity to the blade to minimize the unstretched margin of the carpet as it is presented into overlying relationship with the tack strip.

9 Claims, 5 Drawing Figures

CARPET STRETCHER

This invention relates to a device for installing wall-to-wall carpet and, more particularly, pertains to a carpet stretcher of the type that pulls against a previously emplaced tack strip to anchor the tool during operation.

Numerous devices have been utilized by carpet layers to stretch carpet as it is positioned over a floor for installation. One type is referred to in the trade as a "knee-kicker" type which engages the carpet with a gripping head moved by a kicking action provided by the operator. Another type uses a wall as a backstop and streches carpet toward an opposite wall when a lever is depressed to shift its carpet-gripping head.

Knee-kicker type stretchers, while used for many years by countless carpet layers, have a major disadvantage in that they can cause substantial injury to the layer's knees after prolonged use on a daily basis. The repeated "kicks" which must be applied to the tool through the layer's knees can cause the latter to be quite tender after a day's efforts and can lead to more permanent injury when the tool is used on a regular basis.

Wall engaging stretchers have helped alleviate this problem, because there it is only necessary for the layer to depress a lever by hand to accomplish stretching, but this tool can only be used where a wall is available as a backstop. The ends of hallways, for example, cause considerable problems.

Recently, stretchers which hook behind a carpet tack strip adjacent an interior wall have been developed to provide a compact, easily controlled stretching tool. In these devices, a hand-operated mechanism advances a carpet-engaging head toward a forwardly positioned anchor blade which is hooked behind the tack strip. A problem with stretching tools of this type heretofore available is that they provide limited stretching to the carpet being installed, particularly in the margin adjacent the tack strip. Construction of these stretchers is such that the carpet-engaging head must be positioned a considerable distance from the anchoring means which engages the tack strip, thereby allowing a relatively large portion of carpet to be unstretched.

Additionally, the tack strip engaging carpet stretchers heretofore available have exhibited an unwieldy characteristic when they are shifted from one stretching position to a second stretching position as the installer advances along the carpet periphery. It has been generally necessary to disengage the carpet tool from the tack strip as well as from the carpet when moving the tool to a new position. Consequently, the installer must lift the tool upwardly, shift it to a new position, re-engage the tack strip, and finally re-engage the carpet. This cumbersome procedure increases carpet installation time over that required when using kick-type or wall-engaging carpet stretchers, and has met with poor acceptance.

Another problem with the tack strip-engaging carpet stretchers now in use is the limited access provided by these stretchers to the area immediately above the tack strip. The structural arrangement of these devices is such that visual and manual access to the area above the tack strip is extremely limited. Preferably, the carpet installer should have unrestricted access to this area so that he may properly position the carpet upon the tack strip prior to disengagement of the stretching tool.

Accordingly, it is an important object of the present invention to provide an improved carpet stretcher of the type that engages an emplaced tack strip which presents uniform stretching to the carpet and exhibits superior maneuverability in operation.

Another object of the present invention is to provide a tack strip-engaging carpet stretcher having a carpet-engaging head which operates closely adjacent the anchor means.

Yet another important object of the present invention is to provide a tack strip-engaging carpet stretcher which has a pivotally supported anchor means to allow release of the carpet-engaging head without disengaging the anchor means when maneuvering the stretcher to successive stretching positions along the carpet margin.

Yet another important object of the present invention is to provide a tack strip-engaging carpet stretcher having an anchor supported by a pair of elongate, laterally spaced arms to present ready access to the area immediately above the stack strip.

Another important object of the invention is to provide an apparatus which is easily attachable to wall-engaging type carpet stretchers for converting these stretchers to tack strip-engaging carpet stretchers.

Figure 1:
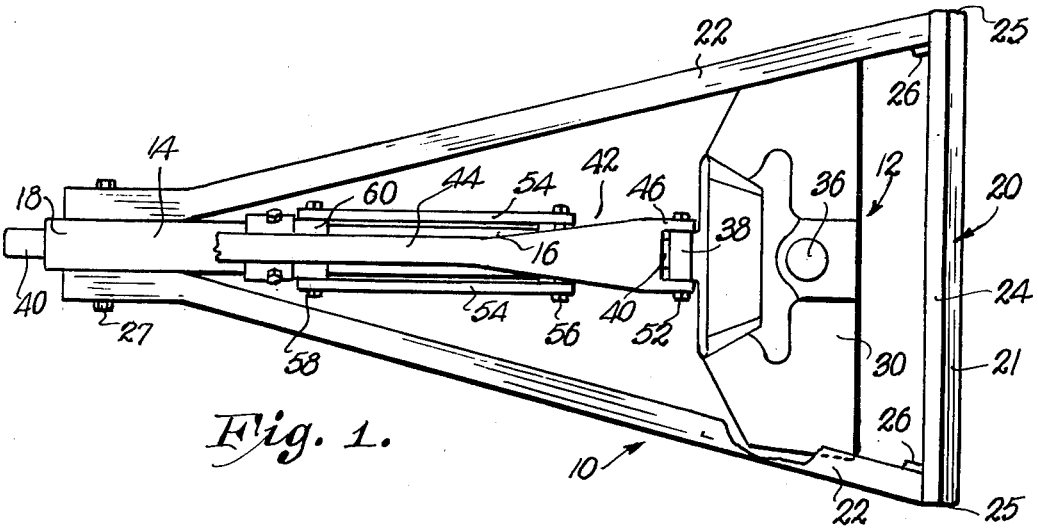
FIG. 1 is a top plan view of a tool constructed in accordance with the principles of the present invention with its carpet-engaging head in its forward position and portions of the lever mechanism broken away for clarity.

Referring now to FIG. 1, a carpet-stretching tool is shown broadly designated by the numeral 10. Tool 10 includes a carpet-engaging head 12 which is shiftably interconnected to a cylindrical, elongate, tubular base 14 adapted to rest upon the surface of the carpet being installed. Base 14 has a forward end 16 and an opposed, rear end 18.

Tool 10 also includes an adapter in the form of an anchor 20 and arm structure 22 which supports anchor 20 forwardly of head 12. The laterally spaced arms 22 converge rearwardly and are pivotally mounted on base 14 by a removable threaded pivot bolt assembly 27 for swinging about an axis transverse to the longitudinal axis of base 14.

Anchor 20 comprises a rigid blade or plate 21 having a slightly inturned, lower edge portion 23, an opposed, generally perpendicularly inturned, upper edge portion 24, and a pair of opposed ends 25. Additionally, anchor 20 is provided with a pair of perpendicularly extending, rectangular gussets 26, each forming a right angle with edge portion 24 proximal to a respective end 25, and a pair of lower support members 28 substantially parallel to edge portion 24. Arms 22 are weldably attached to anchor 20 at opposite ends 25, each arm 22 being engaged by a gusset 26, upper edge portion 24, and a lower support member 28. It will be clear that anchor 20 is rigidly connected to arms 22 and consequently is carried by the arms 22 during swinging of the same relative to base 14.

Figure 2:
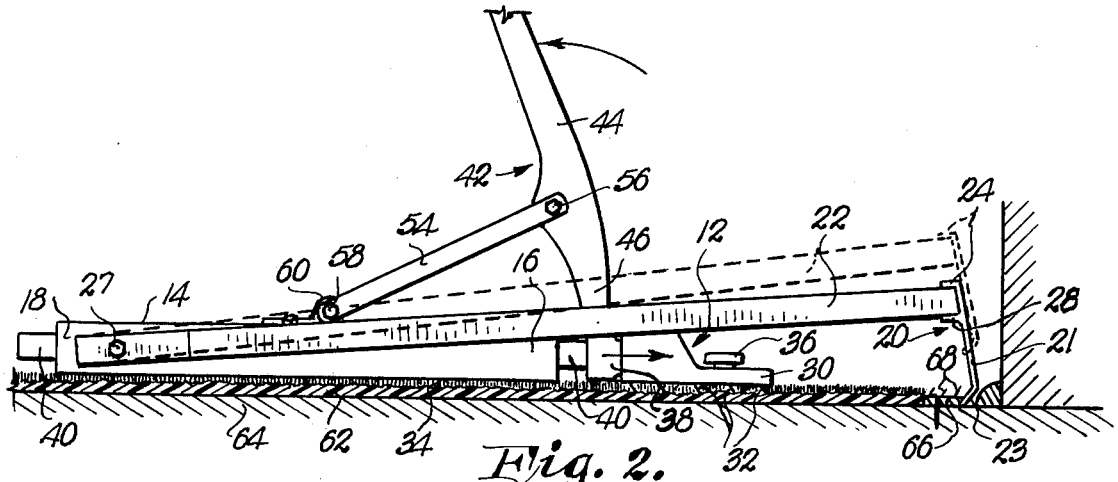
FIG. 2 is a side elevational view thereof showing the head in its retracted position with portions of the lever mechanism broken away, the tool being shown disposed upon a carpet illustrated in cross-section.

Carpet-engaging head 12 comprises a flat, central member 30 having a plurality of adjustable, downwardly extending tines 32 for engagement with the carpet 34 as shown in FIG. 2. Head 12 is additionally provided with a rotatable knob 36 for selectively controlling the downward projection of tines 32 through the mechanism (not shown) well known in the art. Head 12 is also provided with a block 38 and with an elongate, rearwardly extending cylindrical slide member 40.

Base 14 and head 12 are shiftably interconnected by member 40 which is telescopically received within tubular base 14. Lever mechanism 42 operable to shift head 12 relative to base 14 comprises an elongate lever 44 having an apertured end 46 and an opposed grip end 48. A resilient, tubular handle 50 is provided at grip end 48 which is adapted for manual engagement by the carpet installer. Apertured end 46 is pivotally connected to block 38 of head 12 by a pivot pin 52 which extends through the apertures in end 46 and block 38. A pair of elongate links 54 are each pivotally connected at one end to lever 44 by a pivot pin 56 at a point longitudinally spaced from end 46. The opposite end of each link 54 is pivotally connected to tubular base 14 by a pivot pin 58 and a retainer bushing 60 which is rigidly mounted to base 14.

Figure 3:
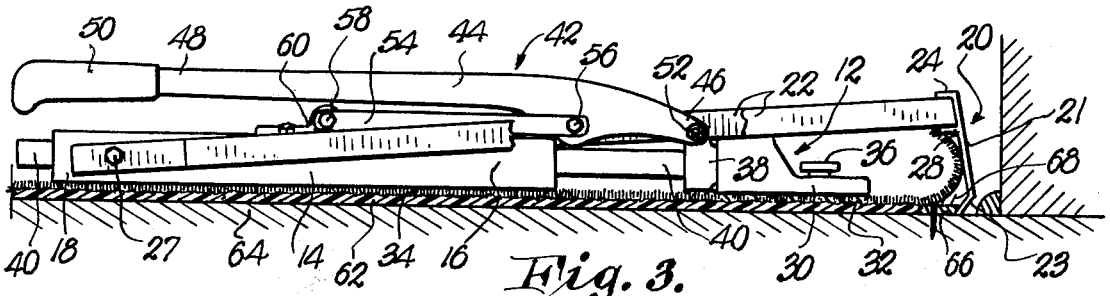
FIG. 3 is a side elevational view as shown in FIG. 2 with the head in its forward position and portions of the tool broken away to show details of construction.
Figure 5:
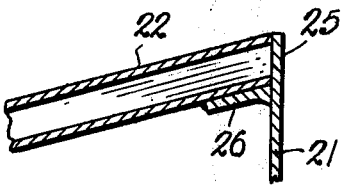
FIG. 5 is an enlarged partial sectional view taken along line 5—5 of FIG. 4.
Figure 4:
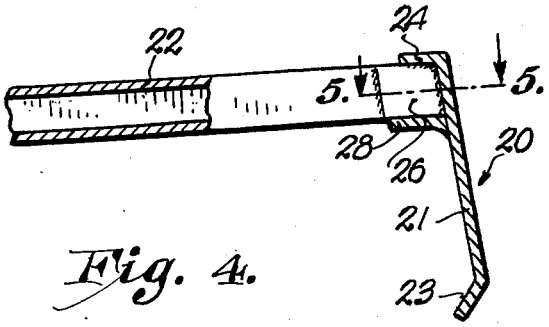
FIG. 4 is an enlarged partial sectional view showing the connection between the anchor blade and its support.

The above described linkage renders lever mechanism 42 operable to shift head 12 toward and away from forward end 16 of base 14, between the latter and anchor plate 21. As shown in FIG. 2, when handle 44 is in a raised position, head 12 is adjacent end 16. As handle 44 is moved downwardly in the direction shown by the arrow in the drawing, head 12 is moved away from end 16 toward plate 21. When handle 44 is positioned parallel to base 14, as shown in FIG. 3, the head 12 is at its forwardmost or stretching position.

As shown in FIG. 2, the carpet stretching tool 10 is adapted to be horizontally disposed upon a carpet being installed. Tubular base 14 and head 12 rest upon carpet 34 which lies over a pad 62 placed upon a floor 64. The carpet 34 is stretched toward a tack strip 66 nailed rigidly to floor 64. A series of spikes 68 project upwardly from strip 66.

In operation, the tool 10 is placed upon a carpet 34 which has been previously laid out over pad 62 on floor 64. The lower edge portion 23 of anchor plate 21 is hooked over tack strip 68 in engagement with the far side thereof. Lever 44 is placed in the raised position to bring head 12 into juxtaposition with end 16 of base 14, and the tool is then pushed downwardly onto carpet 34 to fixedly engage tines 32 with the carpet 34.

To initiate the stretching action, the installer simply operates mechanism 42 by grasping handle 50 and pushing lever 44 downwardly to a position parallel with base 14. Downward swinging of lever 44 causes movement of head 12 away from forward end 16 of base 14, and because the rearwardly directed resistance to stretching is absorbed by tack strip 66 through plate 21, arms 22 and base 14, the carpet margin is stretched toward strip 66.

When the tool 10 is in the stretched position as shown in FIG. 3, the installer merely reaches between arms 22 to push carpet 34 onto tack strip 66 with his hands or a carpet-laying trowel (not shown). Lever 44 is then again brought to its raised position to disengage the carpet which is now retained in a stretched condition by the tack strip 66. Subsequently, base 14 and head 12 are lifted from carpet 34 while lower edge portion 23 of anchor 21 is left in engagement with tack strip 66. In this position the tool 10 may be shifted laterally to a new stretching location and head 12 is again brought into engagement with carpet 34 for repetition of the above-described stretching operation. After completion of the stretching operations, the installer trims the excess carpet at the floor-wall interface. The completed carpet installation has a smooth, uniformly stretched, pleasing appearance.

It will be apparent that arranging the head 12 to operate between base 14 and anchor 20 results in virtually complete stretching of the carpet margin adjacent the tack strip 66. With this arrangement, the head 12 can be advanced much closer to anchor 20 than has heretofore been possible in previous stretchers which utilize the tack strip for an anchor point. Close positioning of head 12 to anchor 20 reduces the unstretched margin of carpet beyond the head 12. It has been found that reducing this unstretched area not only provides better overall stretching of the carpet, but also reduces the undesirable tendency of the carpet to buckle in this area and interfere with placement of the carpet upon the tack strip.

Further, the laterally spaced arms 22 provide the carpet installer with ready access to the edge of the stretched carpet so that he may easily press the carpet down onto tack strip 66 with his hands or a carpet layer trowel. This access allows the installer to rapidly complete the stretching process without complications.

Additionally, a desirable operating characteristic is obtained by pivotally mounting arms 22 to base 14. The vertical pivoting of anchor 20 with arms 22 allows the base 14 and head 12 to be raised from the carpet without disengaging anchor 20 from tack strip 66. Consequently, the installer does not have to repeatedly locate the tack strip 66 with anchor 20 during successive position changes as is the case with previous tack strip-engaging stretchers. Obviously, installation time can be greatly reduced by virtue of the pivoting feature of the present invention.

If it is desired to use the tool between opposed walls instead of as just described, it is a simple matter to remove bolt 27 to detach arms 22 and anchor 20 from base 14. Other components (not shown) may then be added to the rear end 18 of base 14 to lengthen the same as need be in order for the tool to be adapted to push off a rear wall or other backstop rather than pull on a forwardly disposed tack strip. Adapting the tool for tack strip use once again is a simple reversal of this process.

Having thus described the invention, what is claimed as new and desired to be secured by Letters Patent is:

1. An adapter for converting a carpet stretcher having an elongate base and a carpet-engaging head telescopically mounted on the normally front end of the base from a tool that pushes against a rear wall to a tool that pulls against a forward tack strip, said adapter including:

a pair of elongate, laterally spaced apart support arms, each having a first and second end;

a coupler at said first ends for detachably connecting said arms to said base behind said front end; and an anchor carried by said second ends, said arms being of sufficient length to position said anchor beyond said carpet-engaging head when the adapter is connected to said base by said coupler, thereby permitting the anchor to engage the remote edge of a tack strip beyond said head to retain the base as the head is shifted away from said base toward said anchor.

2. An adapter as claimed in claim 1, wherein said coupler is pivotal for swinging of the adapter about an axis transverse to the longitudinal axis of said base when the adapter is attached thereto.

3. An adapter as claimed in claim 1, wherein said arms converge as said coupler is approached.

4. An adapter as claimed in claim 1, wherein said anchor includes an elongate, rigid plate disposed generally perpendicularly to the longitudinal axis of said arms and having an upper edge portion attached to said arms and an opposed lower edge portion presented for engagement with the tack strip.

5. An adapter as claimed in claim 4, wherein said lower edge portion is inturned for positive engagement with the tack strip.

6. An adapter as claimed in claim 5, wherein said arms converge toward said coupler from opposite longitudinal extremes of the plate.

7. A carpet stretcher convertible between a tool that uses a wall-engaging brace to push the carpet away from the wall and one that pulls the carpet toward a tack strip, said stretcher comprising:

an elongated base having opposite front and rear ends, said front end being tubular;

a generally T-shaped unit including an elongated guide member and a transversely extending, carpet-engaging head across one extremity of the member, said member being telescopically received within said tubular front end of the base for extending and retracting the unit relative to the base;

mechanism operably interconnecting said base and the unit for effecting said extension and retraction of the latter, said rear end of the base being tubular for detachably receiving the wall-engaging brace to render the stretcher suitable for stretching the carpet by extending said unit while said brace engages a rearwardly disposed wall;

an anchor plate spaced forwardly from said head in a plane substantially perpendicular to the longitudinal axes of said base and said member;

a pair of laterally spaced arms extending rearwardly from said plate to a point between said opposite ends of the base; and fastener means detachably securing said arms to the base at said point to render the stretcher suitable for stretching the carpet by extending said unit while said anchor plate is hooked behind a forwardly disposed tack strip.

8. A carpet stretcher as claimed in claim 7, wherein said fastener means includes a pivot for rendering said arms swingable relative to said base about an axis transverse to the longitudinal axis of the base.

9. A carpet stretcher as claimed in claim 7, wherein said plate includes an upper edge portion attached to said arms and an opposed, inturned, lower edge portion presented for engagement with the tack strip.

* * * * *